US005397292A

United States Patent [19]

Deckers et al.

[11] Patent Number: 5,397,292

[45] Date of Patent: Mar. 14, 1995

[54] APPARATUS FOR FOLDING SHEETS OF DIFFERENT FORMATS

[75] Inventors: Albert T. Deckers, Maasbree; Floris J. Marcelis, Venlo, both of Netherlands

[73] Assignee: OCE-Nederland, B.V., Venlo, Netherlands

[21] Appl. No.: 268,726

[22] Filed: Jun. 30, 1994

Related U.S. Application Data

[63] Continuation of Ser. No. 10,885, Jan. 29, 1993, abandoned.

[30] Foreign Application Priority Data

Feb. 10, 1992 [NL] Netherlands ..... 9200239

[51] Int. Cl.[6] ..... B41F 13/56; B65H 45/12; B65H 45/14

[52] U.S. Cl. ..... 493/1; 493/23; 493/419; 493/458

[58] Field of Search ..... 493/1, 2, 3, 23, 25, 493/419, 458

[56] References Cited

U.S. PATENT DOCUMENTS

| | | | |
|---|---|---|---|
| 3,698,705 | 10/1972 | Funk et al. | 493/23 |
| 3,831,927 | 8/1974 | Van Herten | 493/416 |
| 4,701,155 | 10/1987 | Ott | 493/14 |
| 4,901,993 | 2/1990 | Hansch | 493/324 |
| 5,045,039 | 9/1991 | Bay | 493/1 |
| 5,120,290 | 1/1992 | Bay | 493/14 |
| 5,224,920 | 7/1993 | Janssen et al. | 493/417 |

FOREIGN PATENT DOCUMENTS 1394480 5/1975 United Kingdom .

OTHER PUBLICATIONS

Foreign Search Report.

*Primary Examiner*—William E. Terrell

*Attorney, Agent, or Firm*—Birch, Stewart, Kolasch & Birch

[57] ABSTRACT

An apparatus for folding and depositing drawings having legends, the apparatus having two folding stations for folding drawings in two directions perpendicular to one another, and a collecting station for collecting the folded drawings with their legend on the same edge. The folding stations fold drawings of a first group, formats (A1 and A2) fed in the transverse direction, first lengthwise and then transversely, and fold drawings of a second group, formats (A0 and A3) fed in the longitudinal direction, first transversely and then lengthwise. Depending upon the group to which they belong, drawings to be folded are folded differently in the two folding stations, namely placing the folding stations selectively in operating states in which the folding stations apply each of the folds to be formed consecutively in directions which are the inverse of one another.

5 Claims, 9 Drawing Sheets

APPARATUS FOR FOLDING SHEETS OF DIFFERENT FORMATS

This application is a continuation, of application Ser. No. 08/010,885, filed on Jan. 29, 1993, now abandoned.

BACKGROUND OF THE INVENTION

1. Field of the Invention

This present invention relates to a sheet folding apparatus, and more specifically to a device for folding sheets of different formats and depositing the sheets in folded form.

2. Discussion of the Related Art

U.S. Pat. No. 4,701,155 describes an apparatus for folding sheets of drawings in the various A1, A2 or A3 formats which drawings are conventionally provided with a legend in the bottom right-hand corner. Sheets of drawings are fed in the feed path of this known apparatus with an orientation such that the drawing, and hence also the legend, is legible when viewed from a specific side of the feed path. Looking in the direction of the feed, the legend is then situated at the left-hand side of the trailing part of the sheet fed in the longitudinal direction. In the first folding station an A1 sheet is folded four times in the transverse direction, an A2 sheet is folded twice or four times and an A3 sheet is folded twice. A packet thus folded in zig-zag fashion is then fed to the second folding station with the legend situated at the top. In the second folding station the zig-zag folded A1 and A2 sheets are double-folded and the zig-zag folded A3 sheet is passed on without any further folding. The sheets folded in this way are then deposited in a collecting station in a uniform way, i.e. with the legends at the top.

One of the features of this known apparatus is that in order to ensure that folded sheets of drawings are deposited with their legends on the same side, the sheets must always be fed with their longest side parallel to the feed direction, and this is hereinafter referred to as longitudinal feed. In the conventional use of this apparatus for folding sheets delivered by a sheet-processing apparatus such as a copying machine wherein the sheets are separated from a roll in such an apparatus, the use of longitudinal feed on its own has the disadvantage in that a separate roll whose length corresponds to the shorter side of the standard format must be provided for each of the standard formats to be folded. Since, in the case of longitudinal feed, the processing capacity of the apparatus is inversely proportional to the length of the longest side of a sheet of drawing, the known apparatus has the disadvantage that the processing capacity is adversely affected in order to achieve the above uniform deposition.

SUMMARY OF THE INVENTION

Therefore, it is an object of the present invention to provide a folding device for folding copy sheets of varying formats which will overcome the above-noted disadvantages.

It is a further object of the invention to provide a sheet folding device having optimal processing capacity.

A further object of the present invention is to provide a novel sheet folding device which generates a uniform deposition of folded sheets of varying formats.

The foregoing objects and others are accomplished in accordance with the present invention, generally speaking, by providing a folding apparatus comprising a first folding station for folding a sheet in a first direction, a second folding station for folding the sheet in a second direction at right angles to the first direction, a delivery station for depositing the folded sheets one upon another, a feed path for feeding the sheets to the first folding station, an intermediate conveying system for conveying the sheets from the first folding station to the second folding station, and a discharge path for discharging the sheets from the second folding station to the delivery station. Control means are provided for selectively operating both the first folding station and the second folding station either in a first operating state, in which sheets which belong to a first group are folded in accordance with a first pattern, or in a second operating state, in which sheets which belong to a second group are folded in accordance with a second pattern, in which operating states the folds to be formed consecutively are applied in directions which are the inverse of one another. As a result, it is possible on the one hand to fold and uniformly deposit sheets whose longest side is of a dimension larger than the working width of the apparatus, i.e. the width of the feed path, these sheets belonging to the first group, while on the other hand optimal processing capacity can be obtained for folding in two directions and uniformly depositing sheets whose longest side is of a dimension equal to or smaller than the working width of the apparatus, these sheets belonging to the second group.

In one embodiment of an apparatus according to the present invention, detection means are provided which detect the format and orientation of a sheet fed in the feed path and, on the basis thereof, detect whether the sheet belongs to the first group or the second group and, in response to the detection by the detection means, the control means sets both the first folding station and the second folding station to the first or second operating state. As a result, the apparatus can be automatically adjusted to an optimal method of folding and discharging a sheet, resulting in rapid processing and uniform disposition of the sheets.

Preferably, the detection means classify a sheet, whose shortest side is equal to or shorter than the maximum distance between two folds that the second folding station can apply, in the same group as a sheet whose longest side is longer than the length of the first folding station in the second direction. Consequently, an A3 format sheet having a legend is folded only in the first folding station so that the folded sheet has a free edge extending on a side of the folded packet situated opposite the corner of the sheet where the legend is situated, this sheet edge being usable as a binding edge so that the folded sheet can be unfolded in the bound condition.

BRIEF DESCRIPTION OF THE DRAWINGS

Other features and advantages of the invention will be described with reference to the following description, reference being made to the drawings wherein.

DETAILED DISCUSSION OF THE INVENTION

Figure 1:
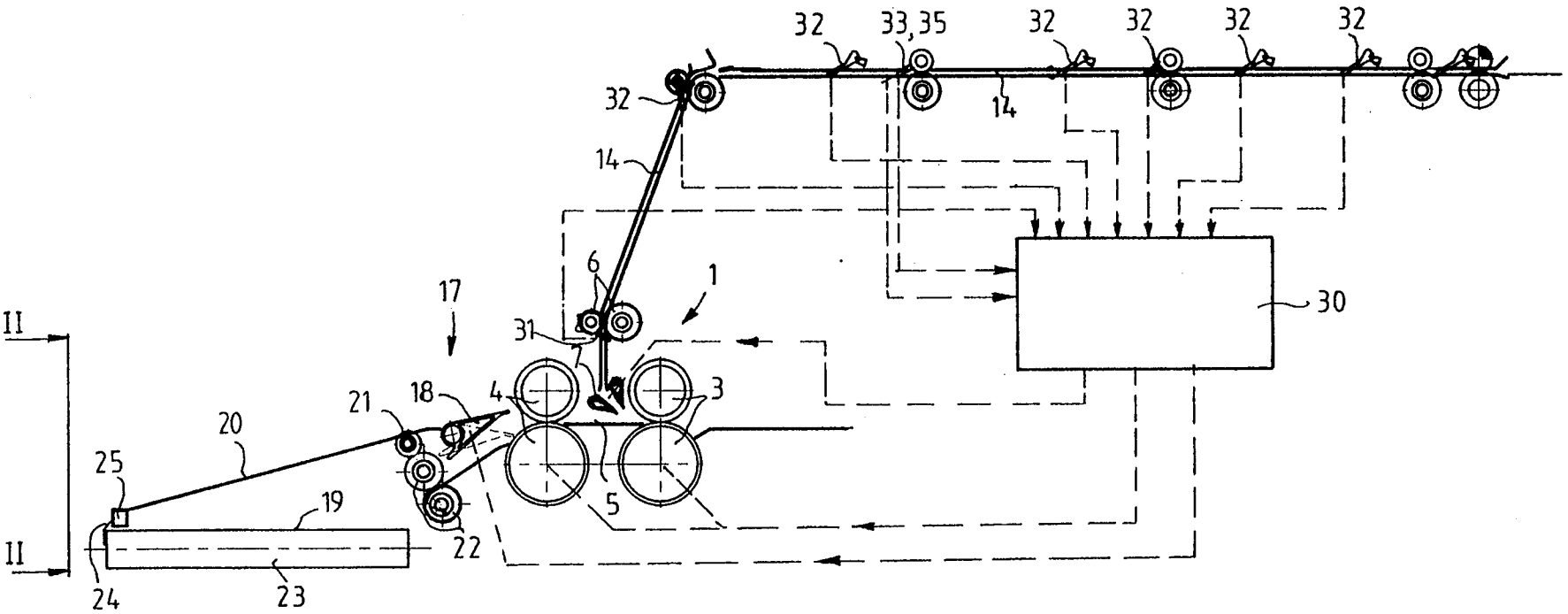
FIG. 1 is a view of an embodiment of an apparatus according to the invention.
Figure 2:
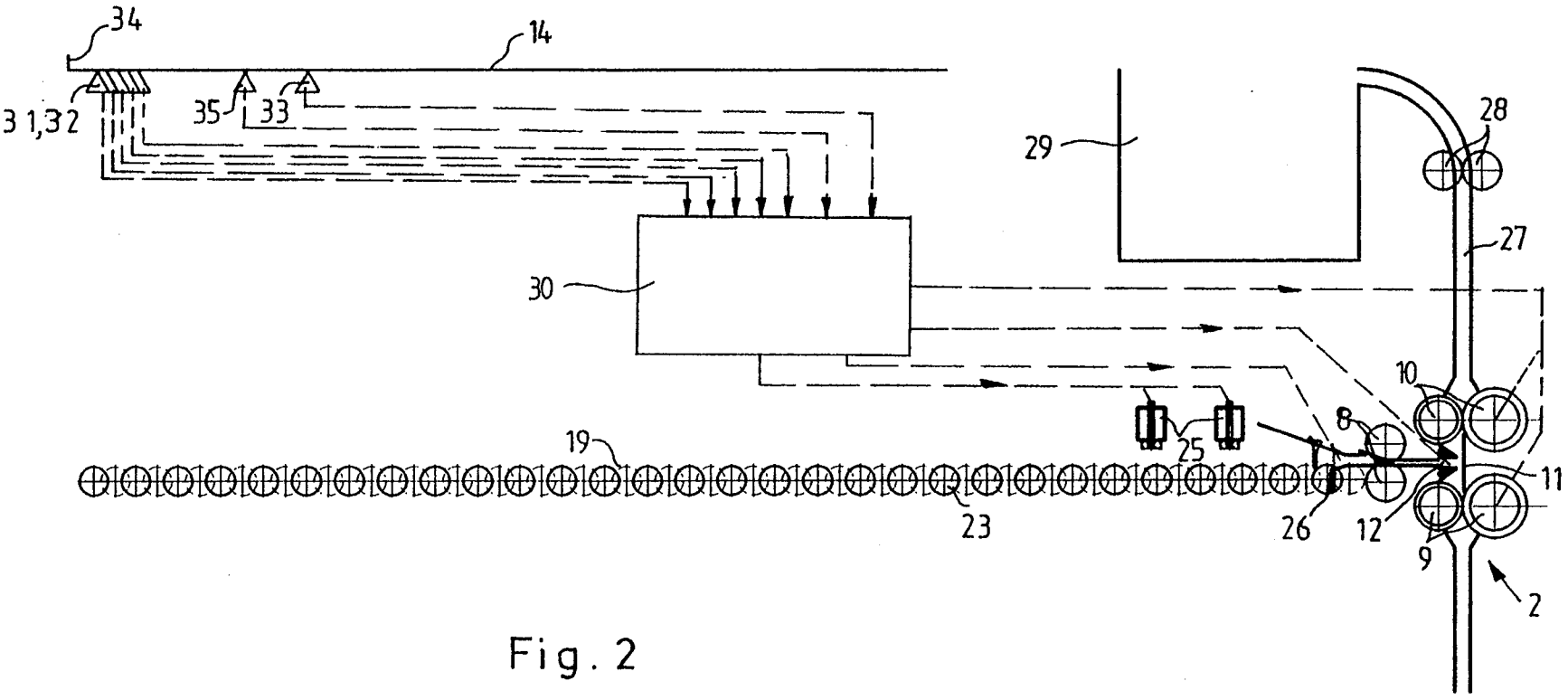
FIG. 2 is a view alon the line II—II of the apparatus of FIG.1.

The apparatus shown diagrammatically in FIGS. 1 and 2 comprises a folding station 1 for the zig-zag folding of a still unfolded sheet and a folding station 2 for the zig-zag folding of the sheet folded in station 1 in a direction transversely to the folding imparted therein. Folding stations 1 and 2 are both of the kind disclosed in British Patent Specification 1, 394,480.

The folding station 1 shown in FIG. 1 comprises folding roller pairs 3 and 4 which define conveying and folding nips disposed at some distance from one another in a common folding plane 5, the directions of rotation of the rollers 3 and 4 being reversible. An input roller pair 6 defines a conveying nip in a plane perpendicular to the folding plane 5 and intersecting the folding plane 5 between the folding nips of the rollers 3 and 4. A funnel-shaped guide member 7 is disposed in a zone between the input rollers 6 and folding rollers 3 and 4 and is displaceable between a position in which a sheet conveyed by the input rollers 6 is guided in the direction of the folding rollers 3 and a position in which a sheet conveyed by the input rollers 6 is conveyed in the direction of the folding rollers 4. To make a fold in a sheet which has been conveyed between the input roller pair 6 and one of the folding roller pairs 3 or 4, the direction of rotation of the folding rollers is reversed and the guide member 7 is moved to the position in which the sheet is guided to the other of the folding roller pairs 4 or 3. As a result, a blouse is formed in the sheet beneath the guide member 7. When this blouse is engaged by the other folding roller pair 4 or 3, a fold forms in the sheet at that place. By moving the guide member 7 back again and reversing the direction of rotation of the folding rollers 3 and 4, given continuous sheet feed, a second fold is formed in the sheet in opposition to the first fold. In this way the sheet can be folded zigzag. The reciprocating movement of the guide member 7 and the direction of rotation of the folding rollers 3 and 4 can be controlled in the way explained in the above-mentioned British patent specification 1,394,480. The folding station 2 illustrated in FIG. 2 is of the same type as folding station 1 and comprises input rollers 8 for inputting a sheet fed through folding station 1, and folding roller pairs 9 and 10 whose nips are situated in a folding plane 11, and a funnel-shaped guide member 12.

In the apparatus shown in FIGS. 1 and 2, folding plane 5 extends horizontally and folding plane 11 vertically. It is of course possible for these folding planes to extend in other directions. It is also possible to use a different type of folding apparatus in the folding stations 1 and 2 from that described above.

In operation, sheets are fed to folding station 1 via a feed path 14 leading into the nip between the input rollers 6. Feed path 14 can be connected to the output of a sheet printing device (not shown), e.g. a copying machine. Sheets folded by folding station 1 can be fed to folding station 2 via an intermediate conveying system 17. Intermediate conveying system 17 comprises a two-position diverter 18 which, when in the position shown in solid lines, diverts a sheet guided in the folding plane 5 towards the diverter 18 to a transverse conveyor path 19 which is disposed lower than the folding plane 5. The diverter 18, when in the position indicated by the broken lines, feeds a sheet guided in the folding plane 5 towards the diverter 18 straight through to an output path 20 which is disposed above the transverse conveyor path 19 and has an output roller 21. A sheet which has been fed out more particularly by folding rollers 4 from the folding station 1 and diverted by the diverter 18 is guided into the transverse conveyor path 19 by a conveying roller pair 22 disposed beyond the diverter 18. The diverter 18 is placed in the solid-line position only in this kind of discharge. The transverse conveyor path 19 is embodied by a bed comprising a large number of rollers 23 whose rotational axes include a small angle with the direction of conveyance of the rollers 3 and 4 of station 1, and by an abutment strip 24 which extends on that side of the transverse conveyor path 19 which is remote from the station 1. The skewing of the rollers 23 causes a sheet to be pressed against the abutment strip 24 during the intermediate conveyance to the folding station 2. The transverse conveyor path 19 has a punching-machine 25 to apply punching holes in an edge of a zig-zag folded sheet which is disposed on the path 19 and which is in engagement with the abutment strip 24. If punching is carried out, folding in the station 1 is so devised in a known manner that this edge projects to form a binding edge. In order to apply the punching holes the transverse conveyance is interrupted by moving, into the path 19, an abutment 26 which stops the zig-zag folded sheet. The top of the vertical folding plane 11 of the folding station 2 is followed by a sheet discharge path 27 having conveying rollers 28 which deposit a sheet fed out of folding station 2 into a delivery tray 29.

A control means 30 is provided to control the folding process to be performed by the folding apparatus shown in FIGS. 1 and 2. This control means 30 cooperates with a detection device which detects that dimension of a fed sheet which extends parallel to the feed direction and which will hereinafter be called "length" for example, in a manner described in the British patent specification 1,394,480. To this end the detection device comprises a sheet detector 31 which is positioned in the feed path 14 at the input to station 1 and which, in response to the detection of the leading edge of a fed sheet, initiates the folding process, as well as sheet detectors 32 which are disposed in the feed path 14 upstream of the sheet detector 31 and which, in response to the detection of the trailing edge of a fed sheet, and in combination with the time interval detected between the two sensors, determine the "length" of a fed sheet, for example, in a manner disclosed in the referenced British patent specification 1,394,480.

FIGS. 3–7 diagrammatically illustrate the position of drawing sheets of different formats during their feed, folding and deposition. The folding apparatus shown in FIGS. 1 and 2 is adapted to process three series of standard formats whose dimensions are given in millimeters in the following table:

| | group 1 | group 2 | group 3 | group 4 | group 5 |
|---|---|---|---|---|---|
| series A | 841 × 1188 (A0) | 594 × 841 (A1) | 420 × 594 (A2) | 297 × 420 (A3) | 210 × 297 (A4) |

-continued

| | group 1 | group 2 | group 3 | group 4 | group 5 |
|---|---|---|---|---|---|
| sereis B | 864 × 1118 | 559 × 864 | 432 × 559 | 279 × 432 | 216 × 279 |
| series C | 914 × 1219 | 610 × 914 | 457 × 610 | 305 × 457 | 229 × 305 |

Figure 3A:
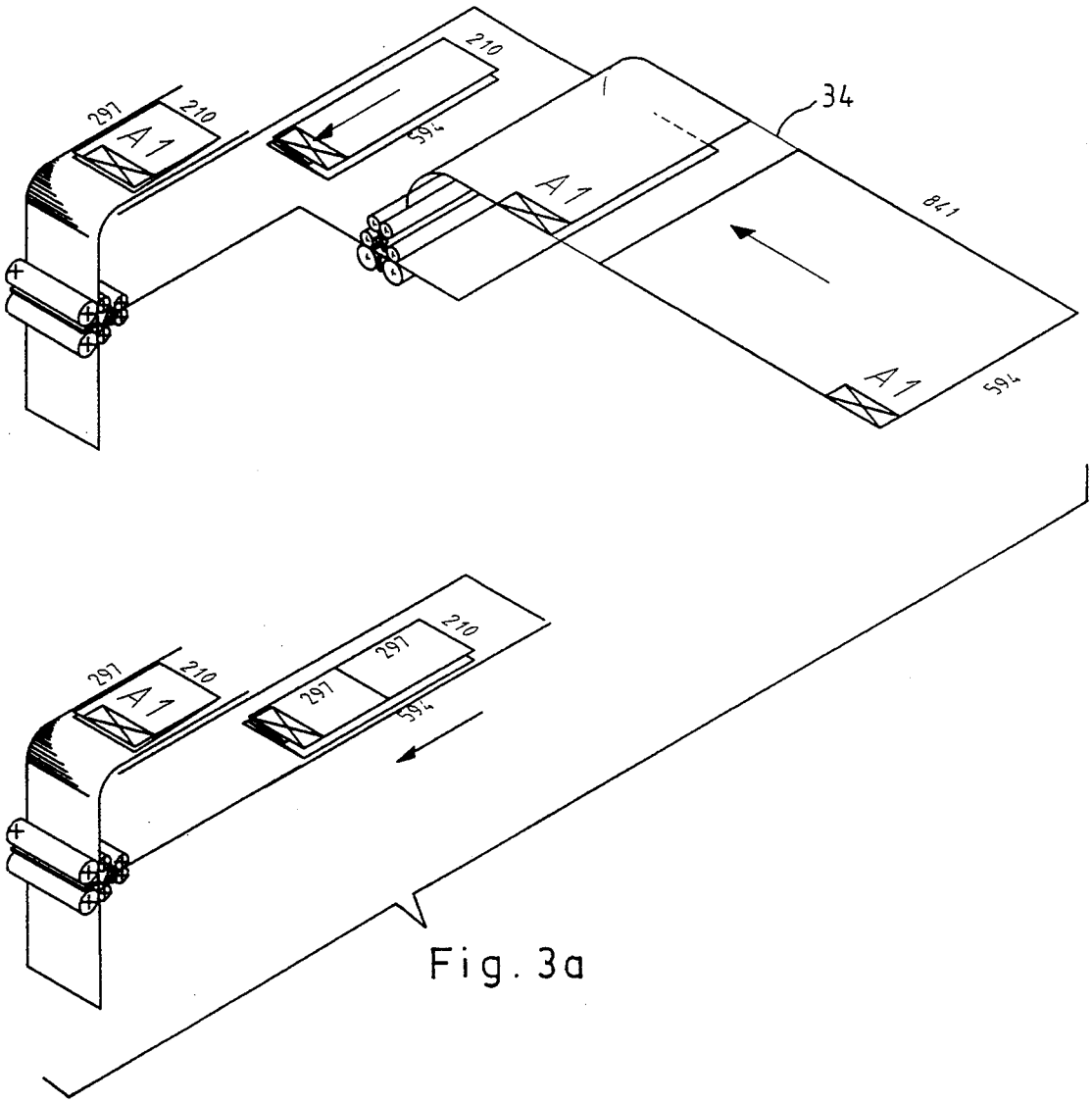
FIGS. 3*a* and 4*a* illustrate the position of an A1 sheet and an A2 sheet respectively when the apparatus is adjusted to the first operating state.
Figure 3B:
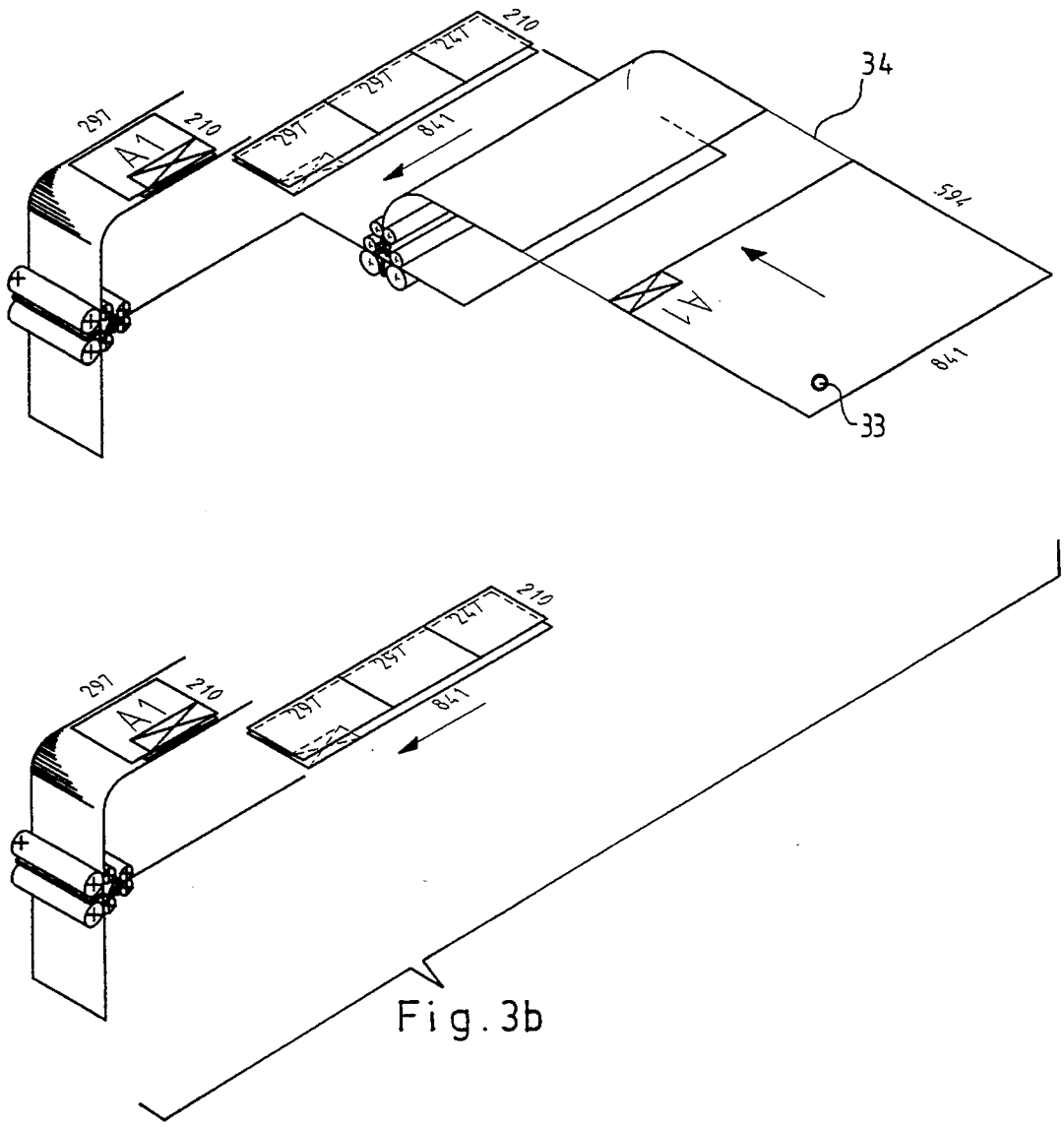
FIGS. 3*b* and 4*b* illustrate the position of an A1 sheet and A2 sheet respectively when the apparatus is adjusted to the second operating state.
Figure 4A:
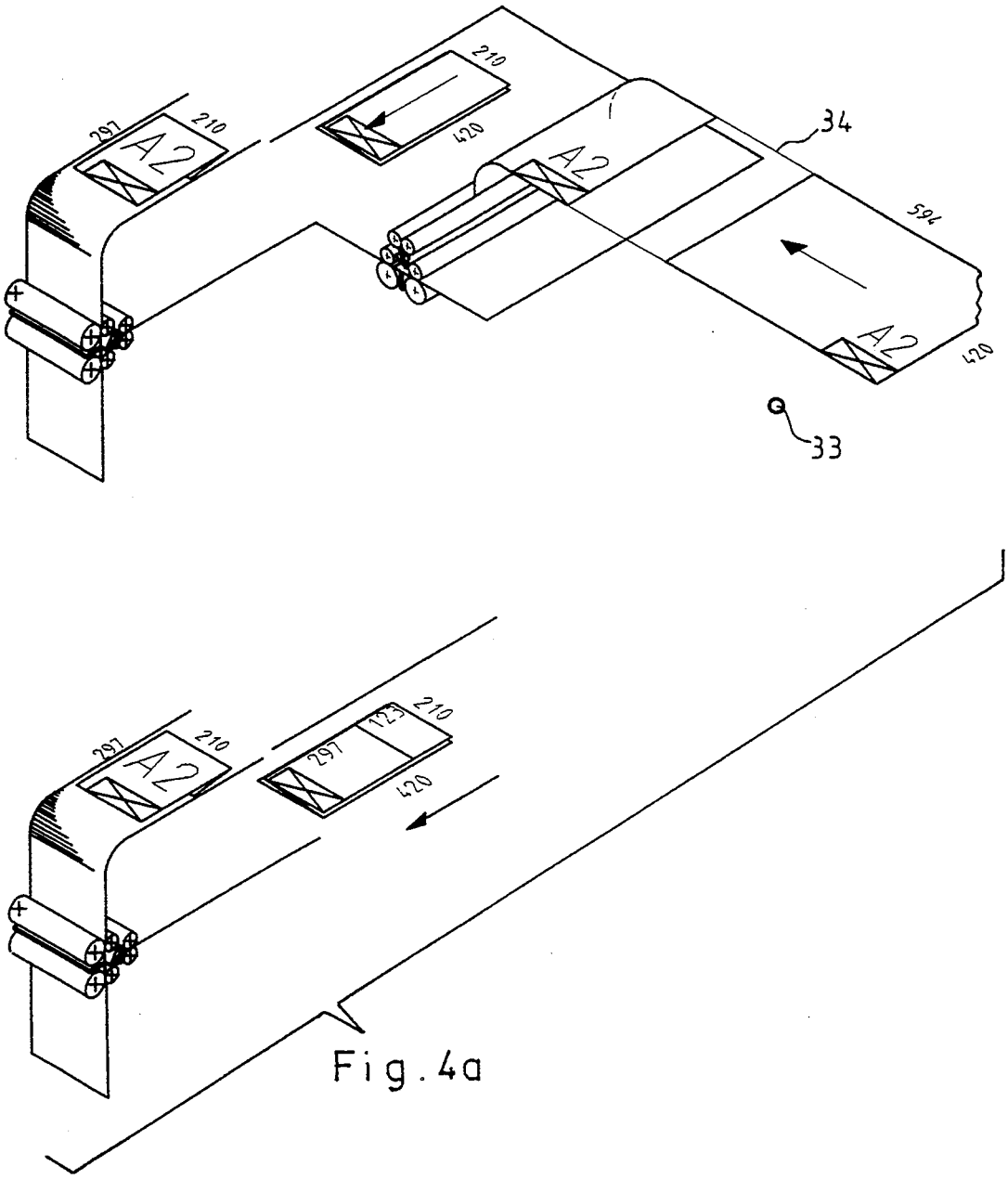
Figure 4B:
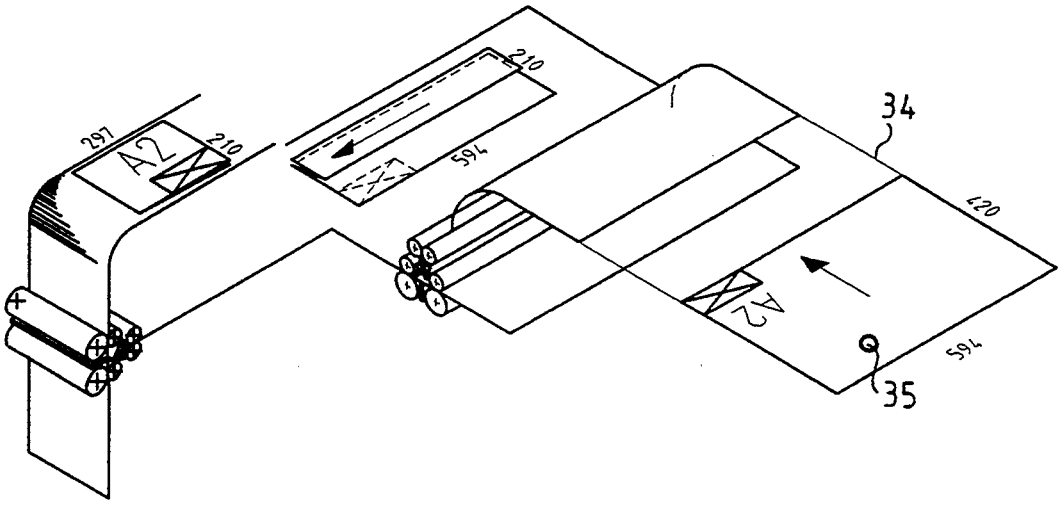
Figure 4B:
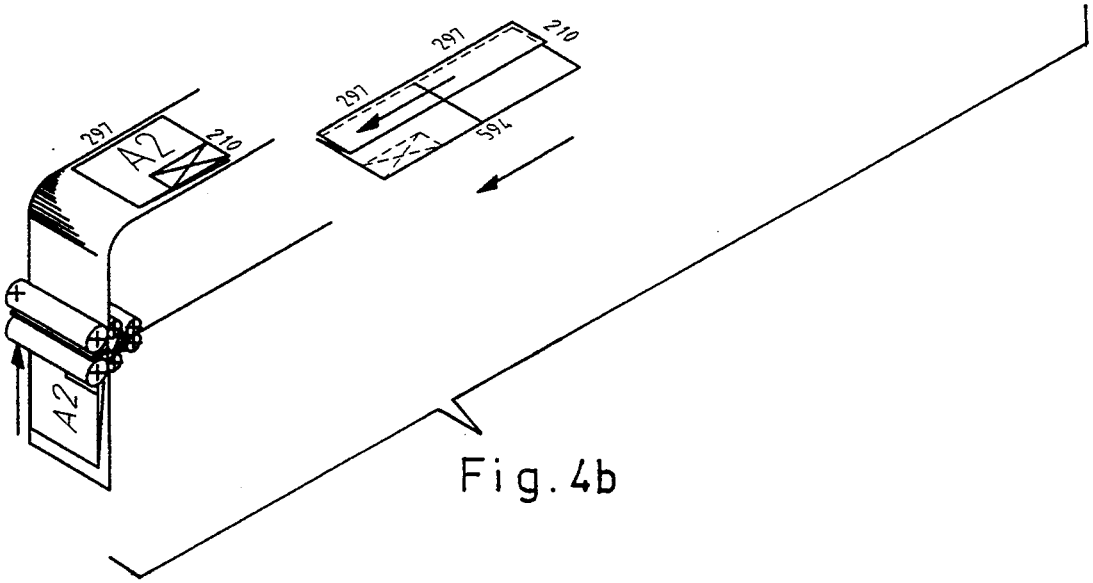
Figure 5:
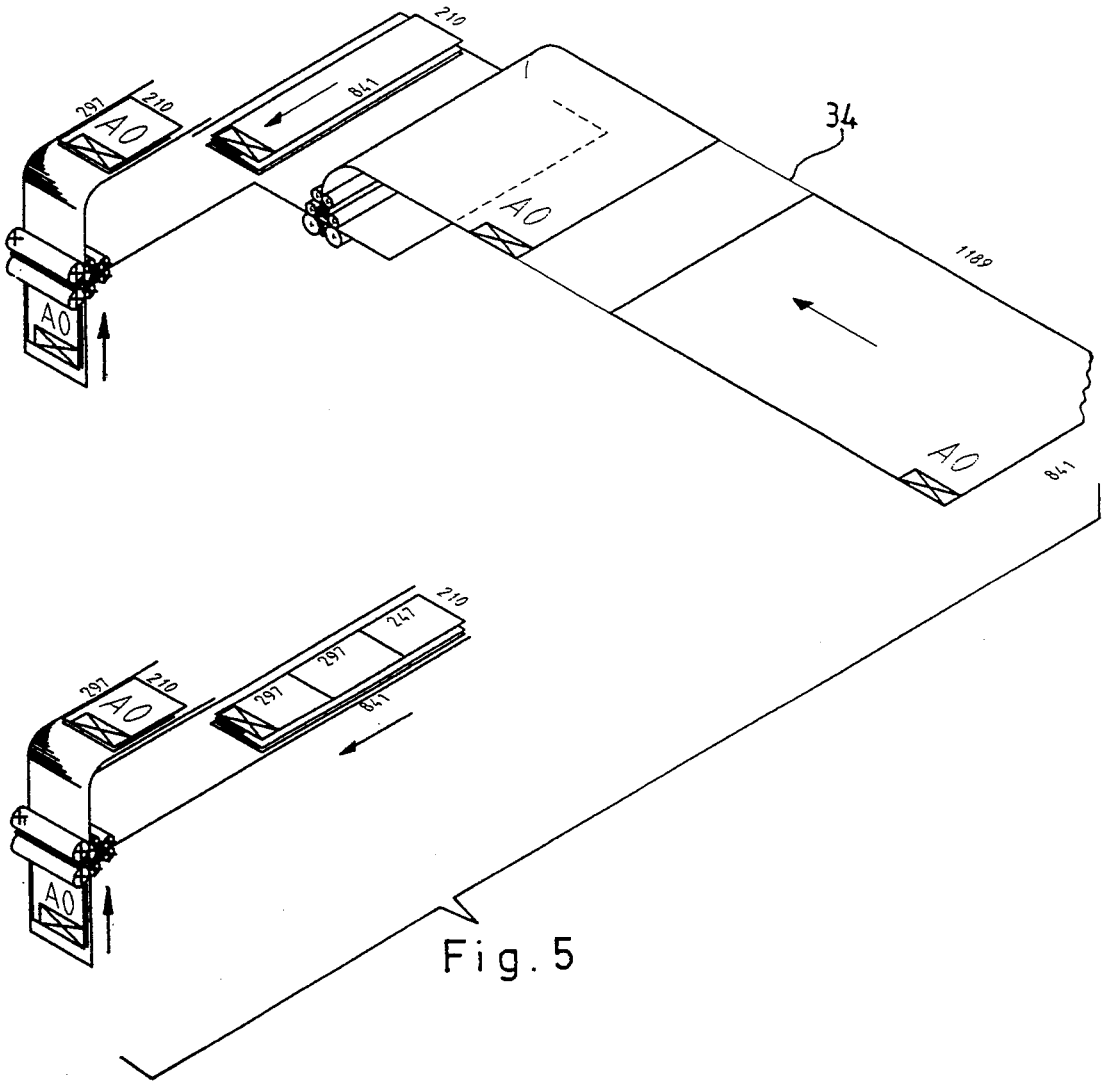
FIGS. 5–7 illustrate the position of an A0 sheet, an A3 sheet and an A4 sheet respectively when the apparatus is adjusted exclusively to the first operating state.
Figure 6:
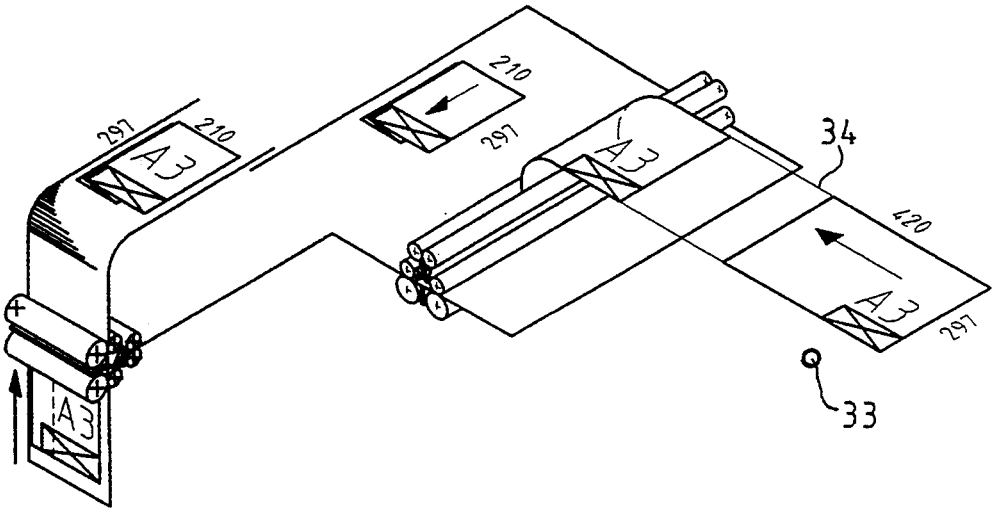
Figure 6:
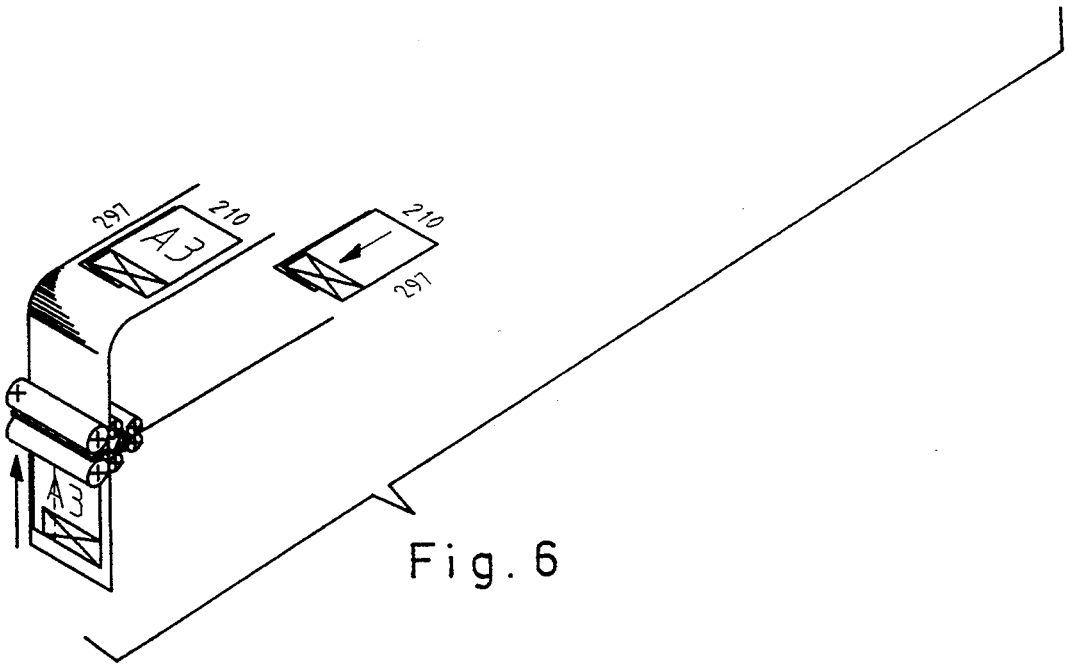

Each column of the table represents a group of sheets which when fed with the longer side parallel to the feed direction (longitudinal feed), are folded the same number of times in both folding station 1 and folding station 2. Because of the limited working width of the folding station 1, group 1 sheets, for example of A0 format, can be fed only in the longitudinal direction, as shown in FIG. 5. Group 2 sheets, for example of A1 format, and group 3 sheets, for example of A2 format, can be fed in the longitudinal direction as shown in FIGS. 3*a* and 4*a* respectively and also in the transverse direction, i.e. with the shorter side parallel to the feed direction, as shown in FIG. 3*b* and FIG. 4*b*, respectively. Group 4 sheets, for example of A3 format, are preferably fed only in the longitudinal direction, as shown in FIG. 6, to ensure that such sheets are folded only in folding station 1 and not in folding station 2. Group 4 sheets fed in the transverse direction would be folded once in folding station 1 and once in folding station 2, thus making it impossible to produce a free binding edge. Group 5 sheets, for example, of A4 format, do not need to be folded and are therefore fed in the transverse direction, as shown in FIG. 7.

If the standard formats hereinbefore mentioned are fed exclusively in the longitudinal direction, the dimension of the shorter side of the sheet, i.e. its width, can be derived from the dimension of the longer side determined by means of the detectors 31 and 32. The control means 30 can determine from this derived size of sheet width the folding program to be performed by the folding station 2. The folding program to be performed by the folding station 1 in that case is derived directly from the measured sheet length. However, if the folding of these standard formats permits a sheet feed in which the shorter side is parallel to the feed direction (transverse feed), means are necessary, at least to be able to discriminate between two formats which, as seen in the feed direction, have substantially the same dimensions but, as seen in a direction transversely to the feed direction, do not, in order to discriminate between an A2 sheet fed in the longitudinal direction and an A1 sheet fed in the transverse direction or between an A3 sheet fed in the longitudinal direction and an A2 sheet fed in the transverse direction. To this end, a sheet detector 33 is provided in the feed path 14 and is positioned at a distance of about 726 mm from the right-hand edge 34 of the feed path 14 and a sheet detector 35 is positioned at a distance of about 508 mm from the right-hand edge 34 in the event of the sheet being fed along the right-hand edge 34, as shown in FIGS. 3–7. An A1 format sheet fed in the transverse direction is detected by the detector 33, as can be seen in FIG. 3*b*, but an A2 format sheet of the same length fed in the longitudinal direction is not, as seen in FIG. 4*a*. An A2 format sheet fed in the transverse direction is detected by the detector 35, as can be seen in FIG. 4*b*, but an A3 format sheet fed in the longitudinal direction is not, as can be seen in FIG. 6. Sheets fed in the longitudinal direction are therefore differentiated from sheets fed in the transverse direction. If the folding apparatus is arranged for all formats to be fed symmetrically in respect of a central line in the feed path, it can be readily determined that the detectors 33 and 35 must be disposed at different distances of, for example, 363 mm and 254 mm from the right-hand edge 34 for automatic detection of the difference hereinbefore referred to.

Figure 7:
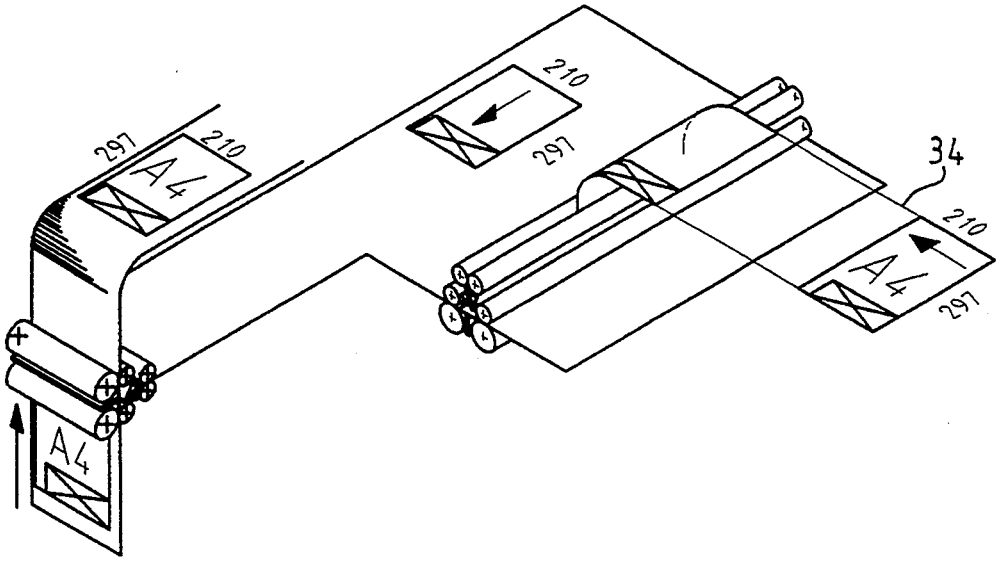
Figure 7:
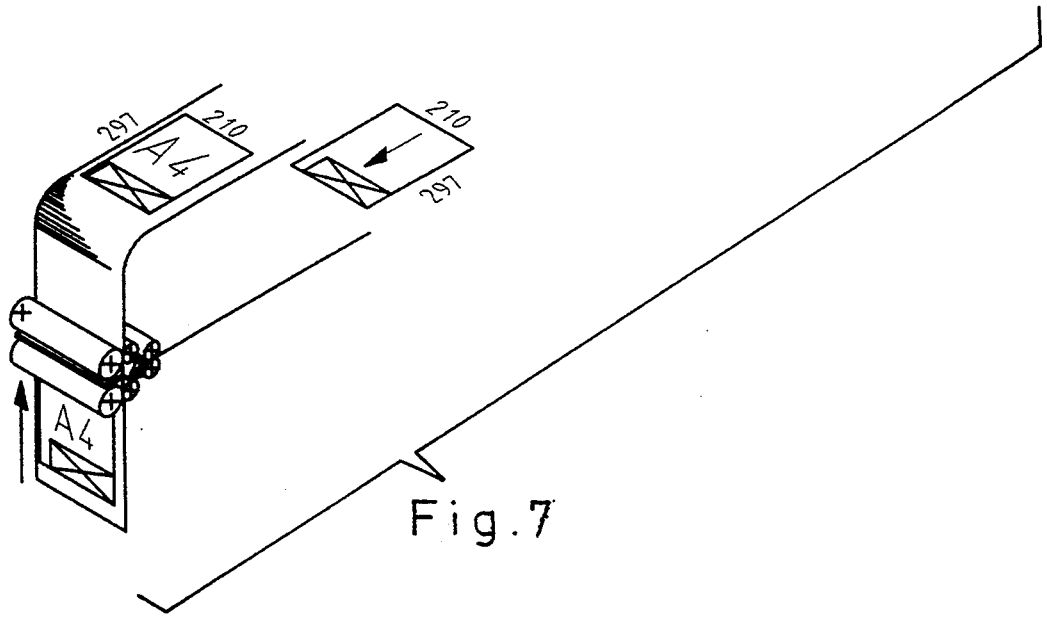

The operation of the folding apparatus shown in FIGS. 1 and 2 will be described hereinafter with reference to the feed of series A drawing sheets as shown in FIGS. 3–7. Operation in the case of the feed of series B and C drawing sheets is the same so far as the number and direction of folds required are concerned. The description given hereinafter will be based on feeding drawing sheets having the picture side facing upwards and having the legend on the left-hand edge. The legend of drawing sheets fed in the longitudinal direction is disposed at the trailing edge of the sheet, as can be seen in FIGS. 3*a*, 4*a*, 5 and 6, whereas in the case of drawing sheets fed in the transverse direction the legend is disposed at the leading edge of the sheet, as can be seen in FIGS. 3*b* and 4*b*. A drawing sheet of a format coinciding with the format of a folded sheet is an exception. In the case of transverse feed of a sheet which remains unfolded, such as an A4 format sheet, the legend is contiguous with the trailing edge of the sheet, as can be seen in FIG. 7.

When, as shown in FIG. 5, an A0 sheet is fed, the control means 30 determines, from signals received from the detectors 31 and 32, that the sheet is an A0 sheet and accordingly sets guide members 7 and 12 initially to a position in which the leading edge of the fed sheet is guided between folding rollers 4 and 9, respectively. In folding station 1 the A0 sheet is folded six times consecutively between alternating folding rollers 3 and 4. When the last fold is made between the rollers 4, the control means 30 changes the diverter 18 over from the broken-line position into the solid-line position in order to convey the A0 sheet, which has been zig-zag folded in one direction, by way of the transverse conveyor path 19 to the folding station 2. The sheet is folded in folding station 2 consecutively once between the folding rollers 10 and once between the folding rollers 9, whereafter it is conveyed by direction reversal of the rollers 9 and 10 and by way of a discharge path 27 to the delivery tray 29 in which it is deposited with its legend facing upwards.

In the case of feed of an A1 sheet in the longitudinal direction (FIG. 3*a*), the control mean 30 determines from signals received from the detectors 31 and 32 that the sheet is an A1 sheet fed in the longitudinal direction and accordingly sets the guide members 7 and 12 initially to a position in which the leading edge of the fed sheet is guided between folding rollers 4 and folding rollers 9, respectively. In folding station 1 the A1 sheet is consecutively folded four times between alternate folding rollers 3 and 4 and, in folding station 2, once between folding rollers 10 and then conveyed through to the delivery tray 29 in which it is deposited with the legend facing upwards.

When an A1 sheet is fed in the transverse orientation (FIG. 3*b*), the control means 30 determines from signals received from the detectors 31, 32 and 33 that the sheet is an A1 sheet fed in the transverse direction and, accordingly, sets the guide members 7 and 12 initially to a position in which the leading edge of the fed sheet is guided between folding rollers 3 and folding rollers 10, respectively. In folding station 1, the A1 sheet is consecutively folded once by the rollers 4 and once by the rollers 3, whereafter the A1 sheet is conveyed to the transverse conveyor path 19 by reversal of the direction of the rollers 3 and 4. In folding station 2, the A1 sheet is consecutively folded once between the rollers 9 and once between the rollers 10 and then passed through to delivery tray 29 in which it is deposited with the legend facing upwards.

When an A2 sheet is fed in the longitudinal direction (FIG. 4*a*), the control means 30 determines from signals received from the detectors 31, 32 and 33 that the sheet is an A2 sheet fed in the longitudinal direction and accordingly sets the guide members 7 and 12 initially to a position in which the leading edge of the fed sheet is guided between folding rollers 4 and folding rollers 9, respectively. In folding station 1, the A2 sheet is folded consecutively once between the rollers 3 and once between the rollers 4 and possibly once more between the rollers 4 and 3, and in folding station 2 the A2 sheet is folded once between the rollers 10, and then passed through to delivery tray 29 in which it is deposited with the legend facing upwards.

When an A2 sheet is fed in the transverse direction (FIG. 4*b*), the control means 30 determines from signals received from the detectors 31, 32 and 35 that the sheet is an A2 sheet fed in the transverse direction and accordingly sets the guide members 7 and 12 initially to a position in which the leading edge of the fed sheet is guided between folding rollers 3 and folding rollers 10, respectively. In folding station 1, the A2 sheet is folded consecutively once between the rollers 4 and once between the rollers 3, whereafter the A2 sheet is conveyed to the transverse conveyor path 19 by direction reversal of rollers 3 and 4. In folding station 2, the A2 sheet is folded once between the rollers 9, whereafter it is guided by reversal of the direction of the rollers 9 and 10 via the discharge path 27 to delivery tray 29 in which it is deposited with the legend facing upwards.

When an A3 sheet is fed in the longitudinal direction (FIG. 6), the control means 30 determines from signals received from the detectors 31, 32 and 35 that the fed sheet is an A3 sheet and accordingly sets the guide members 7 and 12 initially to a position in which the leading edge of the fed A3 sheet is guided between folding rollers 4 and folding rollers 9, respectively. In folding station 1, the A3 sheet is consecutively folded once between the rollers 3 and once between the rollers 4. In folding station 2, the A3 sheet is conveyed without folding and by reversal of the direction of the folding rollers 9 and 10 and via the discharge path 27 to delivery tray 29 in which it is deposited with the legend facing upwards.

When an A4 sheet is fed in the transverse direction (FIG. 7), the control means 30 determines from signals received from the detectors 31 and 32 that it is an A4 sheet and accordingly sets the guide members 7 and 12 to a position in which the leading edge of the sheet is guided between folding rollers 4 and folding rollers 9 respectively, and then led through to be deposited in the delivery tray 29 with the legend facing upwards. When the apparatus of FIGS. 1 and 2 is used to fold sheets delivered by a sheet-processing device in which the sheet material is fed from rollers, a 594 mm long roller can be omitted, but all standard formats can be folded by an A1 sheet always being fed in the transverse direction and an A2 sheet in the longitudinal direction.

Of course the direction of movement of the holding rollers 3, 4 and 9,10 respectively is adapted to the position of the respective guide members 7 and 12. If the folding rollers which are disposed after the folding plane are replaced by an endless belt, the guide members 7 and 12 can be omitted and the initial movement direction of the endless belt determines to which of the remaining folding rollers the leading edge of a fed sheet is guided.

An apparatus derived from the apparatus as shown in FIGS. 1 and 2 comprises just the first folding station 1 in which a first discharge path follows directly on folding rollers 3 and a second discharge path follows directly on folding rollers 4, both discharge paths extending to a delivery station in which one discharge path has zero or an even number of 180° bends and the other discharge path has an odd number of 180° bends. Standard formats fed in the longitudinal direction are first conveyed by way of their leading edge between folding rollers 4 and, after an even number of foldings, are conveyed to the delivery station by way of the discharge path following on the rollers 4. Standard formats fed in the transverse direction are first conveyed by way of their leading edge between the rollers 3 and after an even number of foldings are conveyed to the delivery station by way of the discharge path which follows on the folding rollers 3. As compared with the operation of the apparatus shown in FIG. 1, there is one less reversal of direction of the rollers 3 and 4 for formats fed in the transverse direction, so the processing capacity of the first folding station is optimized.

Of course many variations of the apparatus shown in FIGS. 1 and 2 which fall under the scope of this invention are conceivable. For example, the control of the apparatus described can be adapted to a reversed orientation of sheets to be fed. Adaption of the control to the feed of drawings with their picture side facing downwards means that if the legend is disposed on the right-hand edge of a fed sheet, the sequence of folding between the folding rollers 3 and 4 in the folding station 1 is the reverse. In folding station 2, the sequence of folding by folding rollers 9 and 10 is the reverse only for sheets which have to be folded twice, as compared with the processing hereinbefore described with reference to FIGS. 3–7.

Also, the apparatus described with reference to FIGS. 1 and 2 can be adapted to feeding drawings to be folded with their legend on the upwards facing side of the right-hand edge. For folding station 1, irrespective of format, this adaption means a reversal of the sequence of operations of the folding roller pairs 3 and 4 and, for folding station 2, a reversal of the sequence of operations of the folding roller pairs 9 and 10 for sheets which must be folded once in the folding station 2, as compared with the operation hereinbefore described with reference to FIGS. 3–7. Sheets are deposited in the delivery tray 29 with the legend facing downwards.

If one of the above-described folding and depositing devices is integrated with a sheet printing device, such as a copying machine, detectors 32, 33 and 35 can be omitted and instead the format and orientation in the printing device can be established by reference to the measurement of sheets fed therein. When the printing device is a copying machine, the format and the orientation can also be derived from the format and orientation of the originals to be copied.

If one of the above-described folding and depositing devices is integrated with a copying machine in which the orientation of the image on transfer from an original to a receiving sheet can readily be turned through 90°, as in the case of an electronic copying machine in which the image is stored in an electronic memory during image transfer, it is possible for originals always to be fed uniformly in the same orientation, e.g. longitudinally, when they are scanned. For the sake of a limited number of widths of sheet material to be conveyed with retention of a short processing time in printing and folding, which, as hereinbefore stated, requires transverse feed for some formats, the copier has known means for turning the image through 90°.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for folding sheets of different formats and depositing the sheets in folded form, the apparatus comprising:

a first folding station for folding a sheet in a first direction;

a second folding station for folding said sheet in a second direction at right angles to said first direction;

a delivery station for depositing successive folded sheets one upon another;

a feed path for feeding sheets to said first folding station;

an intermediate conveying system for conveying sheets from said first folding station to said second folding station;

a discharge path for discharging sheets from said second folding station to said delivery station; and a control means for selectively operating both said first folding station and said second folding station either in a first operating state, in which sheets which belong to a first group or format are folded in accordance with a first pattern, or in a second operating state, in which sheets which belong to a second group or format are folded in accordance with a second pattern, in which first operating state each of said folds formed consecutively is applied in a direction which is the inverse of the direction in which each of said folds formed consecutively is applied in the second operating state.

2. An apparatus according to claim 1, further including detection means which detect both format and orientation of a sheet fed in said feed path and, on the basis thereof, detect whether said sheet belongs to said first group or said second group, and wherein said control means in response to detection by said detection means sets both said first folding station and said second folding station to said first or second operating state.

3. An apparatus according to claim 2, wherein said detection means comprises a sheet-length detection means for detecting a dimension of a sheet present in said feed path, as seen in a feed direction, and sheet-width detection means for detecting a dimension of said sheet as seen in a direction transversely to said feed direction, said sheet-width detection means comprising a sheet detector disposed at a place of said feed path such as lies within a zone in which a sheet of a first sort may be disposed, that side of such sheet which extends transversely to the feed direction being longer than a predetermined dimension detected by said sheet-length detection means, such place being disposed outside a zone in which a sheet of a second sort may be disposed, that side of the latter sheet which extends transversely to said feed direction being shorter than a predetermined dimension detected by said sheet-length detection means, and wherein said control means, upon detection by said detection means of a sheet of said first sort, classifies such sheet into a different group than in the case of detection by said detection means of a sheet of said second sort.

4. An apparatus according to claims 2 or 3, wherein said detection means classify a sheet, whose shortest side is equal to or shorter than a maximum distance between two folds that said second folding station can apply, into the same group as a sheet whose longest side is longer than a working width of said folding station.

5. An apparatus for folding and depositing sheets of different formats, the apparatus comprising:

a folding station for folding a sheet in one direction which folding station has opposite exits;

a delivery station for depositing folded sheets one upon another;

a feed path for feeding a sheet to said folding station;

a discharge path for discharging folded sheets to said delivery station, wherein said discharge path comprises a first part and a second part which extend from opposite exits of said folding station to said delivery station, said first part having zero or an even number of 180° bends and said second part having an odd number of 180° bends; and a control means for selectively operating said folding station either in a first operating state, in which sheets which belong to a first group or format are folded in accordance with a first pattern, or in a second operating state, in which sheets which belong to a second group or format are folded in accordance with a second pattern, in which operating states folded sheets thus formed consecutively by said folding station are applied in directions which are the inverse of one another, sheets which have been folded in accordance with said first pattern being discharged by way of said first part of said discharge path and sheets which have been folded in accordance with said second pattern being discharged by way of said second part of said discharge path.

* * * * *